United States Patent [19]

Ohe et al.

[11] Patent Number: 4,792,807

[45] Date of Patent: Dec. 20, 1988

[54] AUTOMOBILE ANTENNA SYSTEM

[75] Inventors: Junzo Ohe; Hiroshi Kondo, both of Aichi, Japan

[73] Assignee: Toyota Jidosha Kabushiki Kaisha, Toyota, Japan

[21] Appl. No.: 843,630

[22] Filed: Mar. 25, 1986

[30] Foreign Application Priority Data

Mar. 27, 1985 [JP] Japan ..... 60-64690

[51] Int. Cl.[4] ..... H01Q 1/32

[52] U.S. Cl. ..... 343/712; 343/713; 343/842

[58] Field of Search ..... 343/711, 712, 713, 741, 343/841, 825, 842, 828, 866

[56] References Cited

U.S. PATENT DOCUMENTS

| | | | |
|---|---|---|---|
| 2,200,674 | 5/1940 | McDonald, Jr. | 343/866 |
| 2,212,253 | 8/1940 | Stief | 343/715 |
| 2,404,093 | 7/1946 | Roberts | 343/715 |
| 2,474,794 | 6/1949 | Van Beuren | 343/842 |
| 2,481,978 | 9/1949 | Clough | 343/712 |
| 2,520,986 | 9/1950 | Williams et al. | 343/712 |
| 2,575,471 | 11/1951 | Schweiss et al. | 343/712 |
| 2,740,113 | 3/1956 | Hemphill | 343/787 |
| 2,774,811 | 12/1956 | Shanok et al. | 343/711 |
| 2,859,441 | 11/1958 | Rosenbaum | 343/712 |
| 2,950,479 | 8/1960 | Pan | 343/702 |
| 2,971,191 | 2/1961 | Davis | 343/712 |
| 3,007,164 | 10/1961 | Davis | 343/712 |
| 3,066,293 | 11/1962 | Davis | 343/767 |
| 3,210,766 | 10/1965 | Parker | 343/743 |
| 3,364,487 | 1/1968 | Maheux | 343/702 |
| 3,611,388 | 10/1971 | Okumura | 343/712 |
| 3,717,876 | 2/1973 | Volkers | 343/712 |
| 3,728,732 | 4/1973 | Igarashi | 343/713 |
| 3,742,508 | 6/1973 | Tomaszewski | 343/713 |
| 3,794,997 | 2/1974 | Iwatsuki et al. | 343/712 |
| 3,823,403 | 7/1974 | Walter et al. | 343/708 |
| 3,916,413 | 10/1975 | Davis | 343/712 |
| 3,961,292 | 6/1976 | Davis | 343/712 |
| 3,961,330 | 6/1976 | Davis | 343/712 |
| 3,972,048 | 7/1976 | Davis | 343/712 |
| 4,003,056 | 1/1977 | Davis | 343/712 |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen | 343/712 |
| 4,339,827 | 7/1982 | Torres et al. | 343/748 |
| 4,499,606 | 2/1985 | Rambo | 455/277 |
| 4,506,267 | 3/1985 | Harmuth | 343/744 |
| 4,566,133 | 1/1986 | Rambo | 455/277 |
| 4,633,519 | 12/1986 | Gotoh et al. | 455/277 |

FOREIGN PATENT DOCUMENTS

| | | |
|---|---|---|
| 0889618 | 9/1953 | Fed. Rep. of Germany . |
| 1131762 | 6/1962 | Fed. Rep. of Germany . |

(List continued on next page.)

OTHER PUBLICATIONS

Japanese Pat. Abstract, vol. 6, No. 37, E-97, Mar. 6, 1982, 56-156031.

Japanese Pat. Abstract, vol. 6, No. 55, E-101, 4/10/82, 56-168441.

Japanese Pat. Abstract, vol. 7, No. E-187, 7/15/83, 58-70640.

Japanese Pat. Abstract, vol. 7, No. E-187, 7/15/83, 58-70642.

*Primary Examiner*—William L. Sikes
*Assistant Examiner*—Michael C. Wimer
*Attorney, Agent, or Firm*—Cushman, Darby & Cushman

[57] ABSTRACT

An automobile antenna system which requires no pole antenna or the like projecting outwardly from the automobile body includes a high-frequency pickup, for example, comprising a loop antenna, which is incorporated within a portion of the vehicle body. The high-frequency pickup is secured to the rear window frame and the longitudinal side of the loop antenna which is partially exposed through the casing of the high-frequency pickup is disposed in the vicinity of an edge-moulding mounting retainer. The loop antenna picks up high-frequency surface currents which are caused by broadcast waves and which concentratively flow in the edge-moulding mounting retainer.

5 Claims, 8 Drawing Sheets

FOREIGN PATENT DOCUMENTS

| | | |
|---|---|---|
| 1949828 | 4/1970 | Fed. Rep. of Germany . |
| 7015306 | 9/1970 | Fed. Rep. of Germany . |
| 2425189 | 12/1974 | Fed. Rep. of Germany . |
| 2701921 | 7/1978 | Fed. Rep. of Germany . |
| 2745475 | 4/1979 | Fed. Rep. of Germany . |
| 2821202 | 11/1979 | Fed. Rep. of Germany . |
| 2733478 | 4/1980 | Fed. Rep. of Germany . |
| 53-22418 | 7/1978 | Japan . |
| 53-34826 | 8/1978 | Japan . |
| 0046617 | 4/1980 | Japan . |
| 55-88407 | 7/1980 | Japan . |
| 59-44861 | 3/1984 | Japan . |
| 59-195811 | 12/1984 | Japan . |
| 60-1008 | 1/1985 | Japan . |
| 60-1009 | 1/1985 | Japan . |
| 60-1010 | 1/1985 | Japan . |
| 60-1011 | 1/1985 | Japan . |
| 60-1012 | 1/1985 | Japan . |
| 0129464 | 8/1985 | Japan . |
| 60-169204 | 9/1985 | Japan . |
| 60-172804 | 9/1985 | Japan . |

AUTOMOBILE ANTENNA SYSTEM

BACKGROUND OF THE INVENTION

1. Field of the Invention

The present invention relates to an automobile antenna system and, more particularly, to an improved automobile antenna system for effectively detecting broadcast waves received by the automobile body and then supplying signals thus detected to various kinds of receivers mounted in the automobile.

2. Description of the Prior Art

Antenna systems are indispensable for automobiles required to positively receive various broadcast and communication waves such as those for radio, television or telephone by using receivers mounted in the automobile. These types of antenna systems are also important in allowing communication to take place between automobiles and other stations, for example, transmitting and receiving citizen band radio waves. Therefore, such antenna systems play a major role in communication functions which will henceforth be regularly incorporated in automobiles.

One conventional type of common antenna system is known as a pole antenna. Although the pole antenna which projects outwardly from the body of an automobile exhibits desirable performance in terms of reception, it has always been the fate of the pole antenna to be treated as a nuisance from the viewpoint of vehicle body design.

Furthermore, the pole antenna involves various problems in that it is exposed to damage such as breakage or bending in actual service and in that it becomes the target of mischief or theft and, additionally, it generates unpleasant noise during high-speed running. For these reasons, there has heretofore been a strong demand for eliminating such pole antennas.

In particular, since frequency bands for broadcast or communication waves received in the interior of an antomobile have recently been widened, it is necessary to install a plurality of antennas corresponding to each of the frequency bands received. Consequently, the installation of a plurality of antennas involves disadvantage in that the aesthetic appearance of an automobile is spoiled and the reception performance of the various antennas is remarkably deteriorated due to the mutual electrical inteference caused therebetween.

Several efforts have previously been made to replace the above-mentioned pole antenna system or to conceal the system from the exterior. As an example, a means of applying a length of antenna wire to the rear windshield of an automobile has been put into practical use.

As another conventional means of solving the above-noted problems, proposals have been made to detect surface currents which are induced by broadcast waves on the vehicle body itself. Although it is considered that, seemingly, the utilization of currents flowing on the vehicle body might be expected to be the most positive and efficient means of reception, the experiments carried out to date have shown disappointing results.

One of the reasons why the surface currents induced on a common vehicle body by broadcast waves have not been utilized well is that the values of the surface currents are not so large as was expected. Although the prior art mainly uses surface currents induced on the roof plate of the vehicle, it is still impossible to obtain a detected output showing a utilizable level.

Another reason is that interference at a high level of noise is mixed in the surface currents. Such noise is mainly generated by the engine ignition system and the battery charging regulator system. As long as the engine is operating, such noise continues to leak into the vehicle body, thus preventing any clear reception of broadcast waves at a practicable level.

Several proposals have heretofore been made in an attempt to cope with these adverse conditions. A conventional type of antenna system using currents induced on the vehicle body by broadcast waves is disclosed in Japanese Patent Publication No. 22418/1978 in which electrical insulation is formed at a portion of the vehicle body on which electric currents are concentrated and the currents flowing between the opposite ends of the insulation are directly detected by a sensor. It is true that this conventional antenna system suggests that it can provide a detected signal of a utilizable level which is superior in S/N ratio. However, since a pickup structure therefor requires a cutout in a portion of the vehicle body, it cannot be applied to normal mass-production types of automobiles.

Another conventional antenna system is disclosed in Japanese Utility Model Publication No. 34826/1978 in which an antenna including a pickup coil for detecting a current flowing in the pillar of a vehicle body is proposed. This prior art was useful in anticipating the course of development of systems based on incorporation of an antenna into a vehicle body. However, it is of no practical use for the pickup coil to be located in the vicinity of a pillar in a direction perpendicular to the longitudinal axis thereof. In addition, since this pickup arrangement is not capable of providing any antenna output of utilizable level, it has been regarded merely as a casual idea.

As described above, the prior-art antenna systems have not necessarily been successful in detecting currents induced on the vehicle body by broadcast waves.

In particular, no solution has heretofore been found to various problems which arise with a pickup structure for effectively detecting currents induced by broadcast waves which are conducted by the vehicle body and a pickup arrangement capable of obtaining a utilizable S/N ratio. Rather, the results of various kinds of experiments have suggested that it might be theoretically impossible to use an antenna system which utilizes currents flowing on the vehicle body.

SUMMARY OF THE INVENTION

The present invention has been devised in the light of the above described problems of the prior art, and its object is to provide an improved small-size antenna system for automobiles capable of effectively detecting currents induced on the automobile body by broadcast waves and then transferring detected signals to a receiver mounted in the automobile.

To this end, the present invention provides an antenna system having a high-frequency pickup disposed in close proximity of a peripheral edge portion of the vehicle body for detecting high-frequency surface currents having a predetermined frequency or greater.

In particular, the antenna system of this invention is applied to an automobile having an edge-moulding mounting retainer which functions as an antenna for receiving television-band broadcast waves and which is mounted on the roof plate of the vehicle body in such a manner as to be separate from the rear windshield frame as an independent member.

Specifically, the retainer has a longitudinal length substantially equal to a television band wavelength and the high-frequency pickup is disposed along the length of the retainer in the vicinity of the peripheral edge portion thereof.

The prior art antenna systems have mainly been designed to receive AM band waves to meet the needs of the times. Consequently, since the wavelengths of broadcast waves are too large to be received, antenna systems based on the detection of the vehicle body currents cannot achieve proper reception characteristics. The inventors took notice of this frequency-dependent property and, in the present invention, selected 50 MHz or greater, which is above the AM frequency band, as broadcast waves being received, thereby enabling remarkably effective reception from vehicle body currents which has conventionally been considered impossible.

The inventors also took notice of the fact that such high-frequency body currents have distribution characteristics in which the current values thereof remarkably differ at each portion of the vehicle body. In accordance with the present invention, the high-frequency pickup is disposed at a position which is substantially free from any noise and in which the currents induced by broadcast waves show a high density, and a portion neighboring the peripheral edge of the automobile body has been specifically chosen as a place for installation capable of satisfying this condition.

Furthermore, in accordance with the present invention, the high-frequency pickup is disposed along the peripheral edge of the body within a range represented by $12\times10^{-3}$ c/f(m) in order to positively detect the high-frequency currents having the above-mentioned frequency characteristics. As a pickup, a loop antenna is adopted for electromagnetically detecting magnetic flux produced by the vehicle body currents, thereby achieving an efficient detection effect.

BRIEF DESCRIPTION OF THE DRAWINGS

The above and other objects, features and advantages of the present invention will become apparent from the following description of the preferred embodiment thereof, taken in conjunction with the accompanying drawings in which.

DESCRIPTION OF THE PREFERRED EMBODIMENTS

Preferred embodiments of the automobile antenna system in accordance with the present invention will be described below with reference to the accompanying drawings.

FIGS. 4 to 12 illustrate a process of finding the most efficient antenna mounting position in terms of reception through the distribution characteristics of high-frequency currents.

Figure 4:
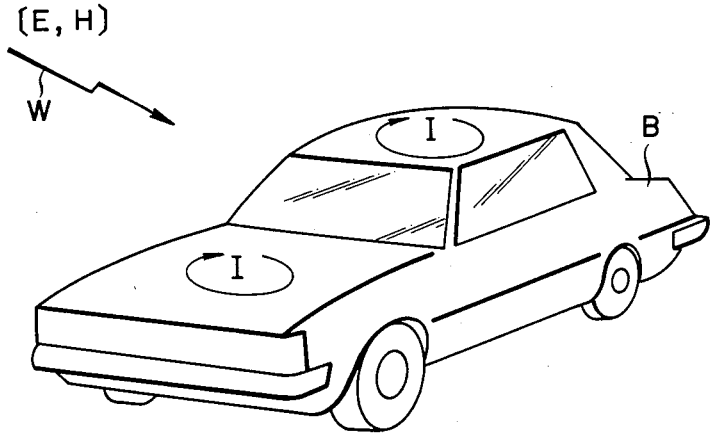
FIG. 4 illustrates surface currents I induced on the vehicle body B by external waves W.

FIG. 4 shows that when external electromagnetic waves W such as broadcast waves pass through a vehicle body B made of conductive metal, surface currents I are induced at various points of the vehicle body B at levels corresponding to the intesities of electromagnetic waves passing therethrough. The present invention is aimed only at electromagnetic waves which belong to relatively high frequency bands of 50 MHz or greater, such as FM waves, television waves and others.

The present invention is characterized in that the distribution of the surface currents induced on the vehicle body by electromangetic waves within the above described particular wave bands is measured with a view to identifying a position of the vehicle body which is high in surface current density and low in noise and at which a pickup as provided for by the present invention may be located.

The distribution of surface currents is determined by a simulation using a computer and also by measuring actual intensities of surface currents at various positions on a vehicle. In accordance with the present invention, the measurement is carried out by the use of a probe which can operate in accordance with the same principle as that of a high-frequency pickup actually located on the vehicle body at the desired position. Such a probe is moved on the vehicle body throughout the entire surface thereof to measure the level of surface currents at various positions of the vehicle body.

Figure 5:
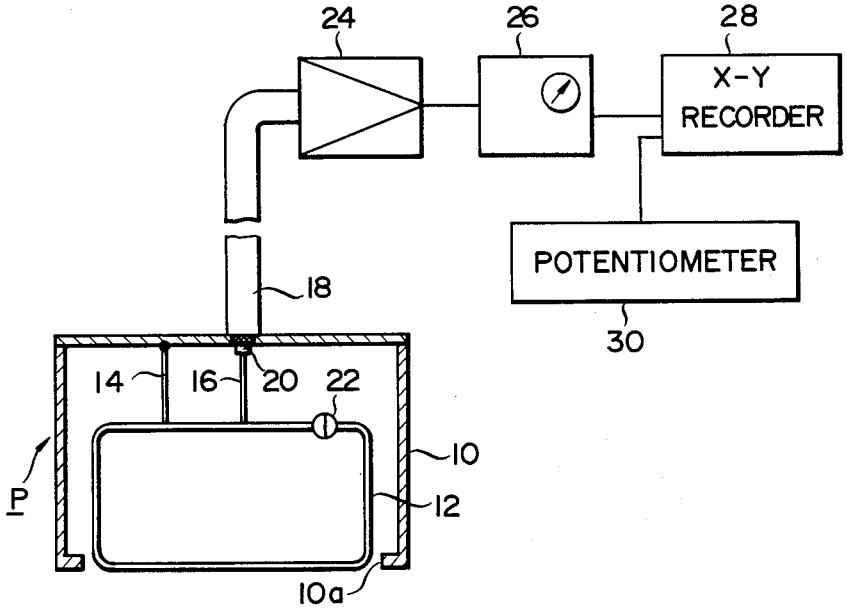
FIG. 5 illustrates a probe for detecting the distribution of surface currents on the vehicle body and having the same construction as that of the high-frequency pickup used in the present invention, and a circuit for processing signals from the probe.

FIG. 5 shows the general construction of such a probe P which is constructed in accordance with substantially the same principle as that of the high-frequency pickup described hereinafter. The probe P is composed of a casing 10 of electrically conductive material for preventing interference by external electromagnetic waves and a loop coil 12 is secured to the interior of the casing 10. The casing 10 includes an opening 10*a* formed therein through which a portion of the loop coil 12 is exposed to the exterior. The exposed portion of the loop coil 12 is positioned in close proximity to the surface of the vehicle body B to detect magnetic flux induced by surface currents on the vehicle body B. Another portion of the loop coil 12 is connected to the casing 10 through a short-circuiting line 14. The loop coil 12 further includes an output end 16 connected to a core 20 in a coaxial cable 18. Still another portion of the loop coil 12 includes a capacitor 22 for causing the frequency of the loop coil 12 to resonate relative to the desired frequency to be measured so as to increase the efficiency of the pickup.

Thus, when the probe P is moved along the surface of the vehicle body B and also angularly rotated at various points of measurement, the distribution and direction of surface currents on the vehicle body can be accurately measured. In FIG. 5, the output of the probe P is amplified by a high-frequency voltage amplifier 24 and the resulting output voltage is measured by a high-frequency voltmeter 26. This coil voltage output is read through a value indicated by the high-frequency voltmeter 26 and a voltage corresponding to the value indicated by the voltmeter 26 is recorded by an XY recorder 28 to provide the distribution of surface currents at the various positions of the vehicle body. Signals indicative of various positions is fed from a potentiometer 30 to the input of the XY recorder 28, whereby the high-frequency surface currents at each of the positions thereof can be ascertained.

Figure 6:
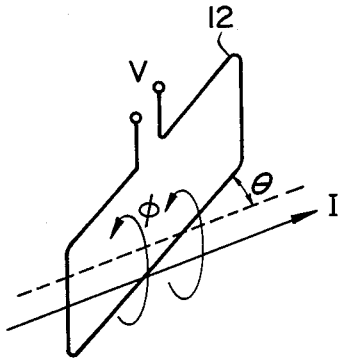
FIG. 6 illustrates the electromagnetic coupling between the surface currents I and the pickup loop antenna.
Figure 7:
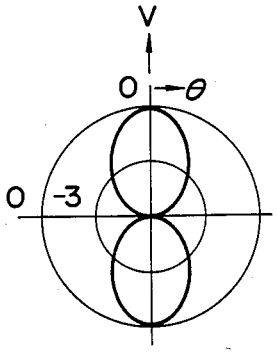
FIG. 7 illustrates the directivity of the loop antenna shown in FIG. 6.

FIG. 6 shows a declination $\theta$ which is formed by the high-frequency surface currents I and the loop coil 12 of the pickup, and, as shown in this figure, a magnetic flux $\phi$ caused by the currents I crosses the loop coil 12 so as to generate a detected voltage V at the loop coil 12. As shown in FIG. 7, when $\theta$ is 0, that is, when the surface currents I are parallel to the loop coil 12 of the pickup, the maximum level of voltage can be obtained and the direction in which the surface currents I flow when the maximum voltage is obtained can be found by rotating the probe P at the respective points of measurement.

Figure 8:
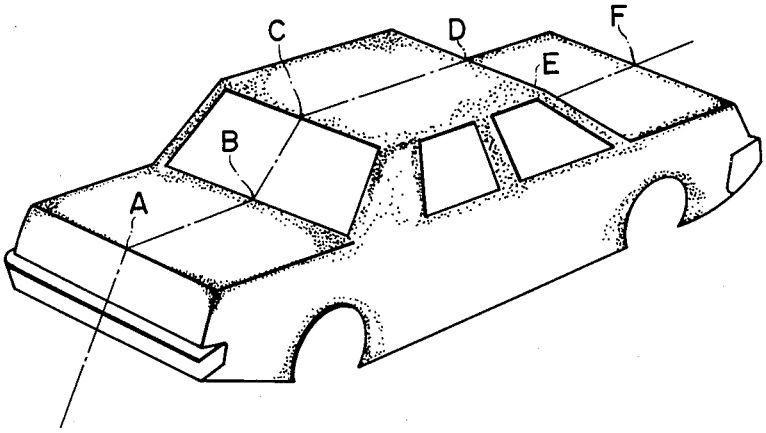
FIG. 8 illustrates the distribution characteristics of the intensity of the surface currents.
Figure 9:
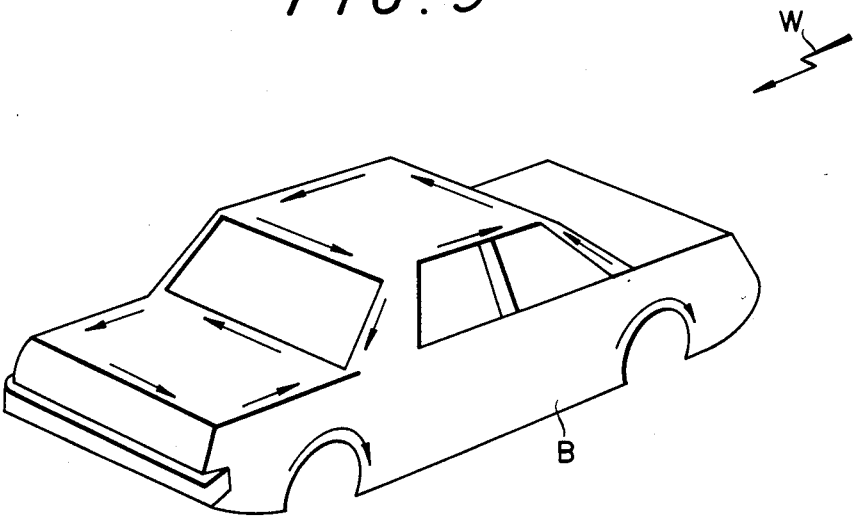
FIG. 9 illustrates the directions of flow of the surface currents.

FIGS. 8 and 9 shows the magnitude and the direction of the high-frequency surface currents generated at the respective positions on the vehicle body at a frequency of 80 MHz which is found on the basis of both the results obtained from measurement by the probe P and a computer simulation. As shown in FIG. 8, the magnitude of the surface currents is distributed in such a manner that current density is high at the portions along the edge of each flat portion of the vehicle body while it is extremely low at the center of each flat portion thereof.

As indicated by the arrows (showing the direction of each current flow) shown in FIG. 9, it will be understood that the respective currents are concentrated in a direction parallel to each edge of the vehicle body or along each portion which forms a junction between the flat portions.

Figure 11:
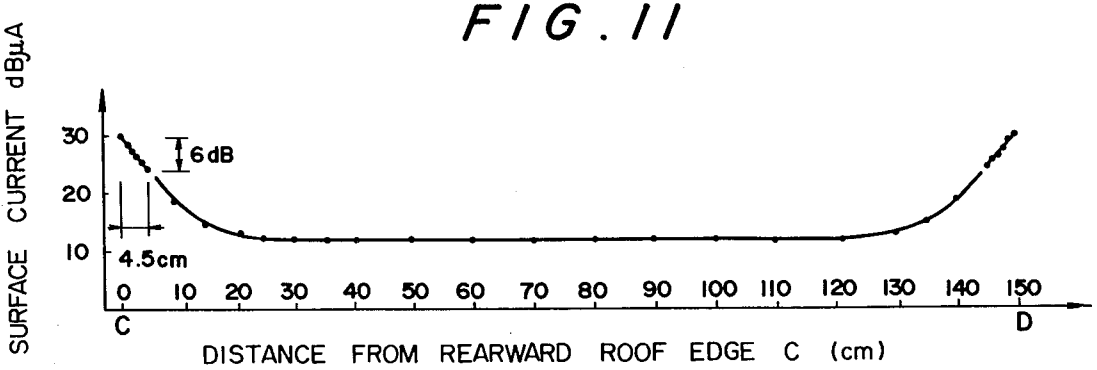
FIGS. 10, 11 and 12 are graphs showing the distribution of surface currents at various points of the automobile body shown in FIG. 8 along the longitudinal axis thereof, respectively.
Figure 10:
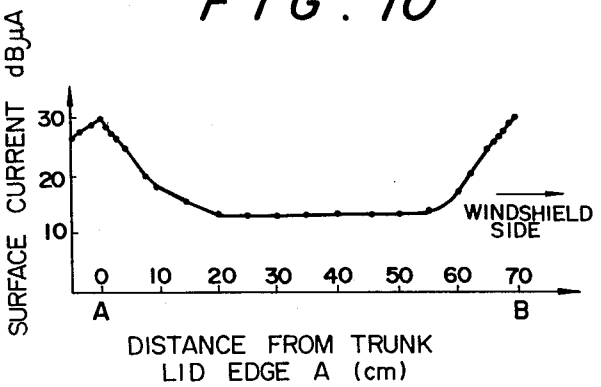
Figure 12:
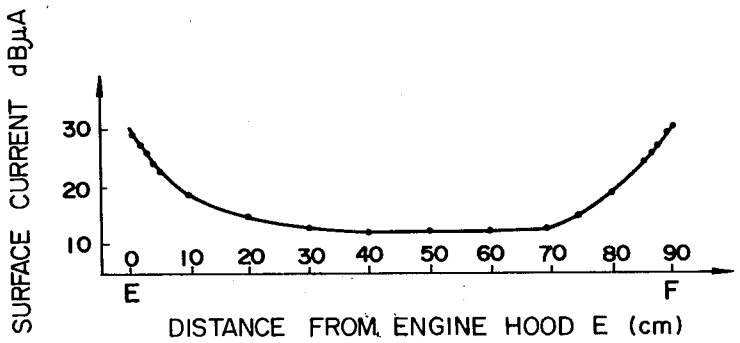

When the distribution of the currents which are induced on the metal portion of the vehicle is examined in detail along the one-dot chain line in FIG. 8 which runs lengthwise over the vehicle, distribution characteristics as shown in FIGS. 10 to 12 are obtained.

FIG. 10 is a graph showing the distribution of the surface currents which appear along the line between points A and B on the trunk lid. As clearly shown in this figure, the distribution characteristics are such that the maximum level of currents flow at the oppsite ends of the lid while the current value decreases from the ends of the lid to the center thereof.

As can be seen from FIG. 10, the disposition of the high-frequency pickup in the vicinity of a peripheral edge portion of the trank lid enables the detection of the currents concentratively flowing near this peripheral edge portion.

Likewise, FIG. 11 shows the current distribution along the chain line shown in FIG. 8 running over the roof plate of the vehicle body and FIG. 12 shows that along the same chain line where it runs over the bonnet of the engine compartment. As will be understood from the two figures, the maximum level of current is conducted at both ends of the roof plate and the engine compartment bonnet, respectively, and, conversely, the current values decrease toward the center thereof.

Accordingly, it will be readily understood that, in accordance with the present invention, broadcast waves can be picked up with proper sensitivity in the vicinity of each peripheral edge of the vehicle body.

It is a matter of course that, in the present invention, the high-frequency pickup mounting position is not limited to the bonnet or the roof plate noted above and the system of this invention may be applied to a pillar or a fender in a similar manner.

Furthermore, in accordance with the present invention, the high-frequency pickup is mounted in such a manner that, as an example, the length of the loop antenna is located in close proximity to and along the peripheral edge portion of each vehicle body. In this case, it is preferable that the pickup mounting zone along the peripheral edge is set within a range which is dependant upon the carrier frequencies of broadcast waves whereby excellent sensitivity can be achieved in practical terms.

The distribution characteristics shown in FIGS. 10 through 12 are those of the vehicle body currents with respect to an FM broadcast frequency of 80 MHz in which, as described above, the value of each surface current is lowered in accordance with the distance from the end or edge of each vehicle body. As can be seen from these characteristics, since a satisfactory sensitivity can be actually achieved within a current lowering range of 6 dB or less, remarkably excellent sensitivity can be accomplished within 4.5 cm from the edge.

Therefore, in accordance with the present invention, it is possible to obtain a satisfactory antenna system in practical terms by disposing the high-frequency pickup within 4.5 cm from the edge of a vehicle body with respect to a carrier frequency of 80 MHz.

In addition, the results of a computer simulation and various experiments clearly show that this utilizable margin depends upon carrier frequencies and it has been recognized that the utilizable margin decreases as the frequencies increase.

Accordingly, in this invention and on the basis of the above mentioned facts, namely that the utilizable margin at a carrier frequency of 80 MHz is 4.5 cm and is inversely propotional to any increase in frequency if a high-frequency pickup mounting range from the edge of the flat metal portion of the vehicle body is set within the following dimension:

$$12\times10^{-3}\ c/f(m),$$

proper reception can be achieved in correspondence with any desired carrier frequency (where, c=the speed of light and f=the carrier frequency).

As described above, in accordance with the present invention, the high-frequency pickup is disposed in close proximity to an edge portion of a metal vehicle body, and is preferably located within the above-noted margin from the edge, thereby accomplishing a proper reception effect.

In accordance with the present invention, the actual margin in each case depends on the particular frequency. As an example, at a carrier frequency of 100

MHz, the high-frequency pickup may be located within 3.6 cm from the edge of the vehicle body. Hence, as the carrier frequency f increases, the high-frequency pickup mounting position is limited to a progressively narrower area extremely close to the edge.

Figure 1:
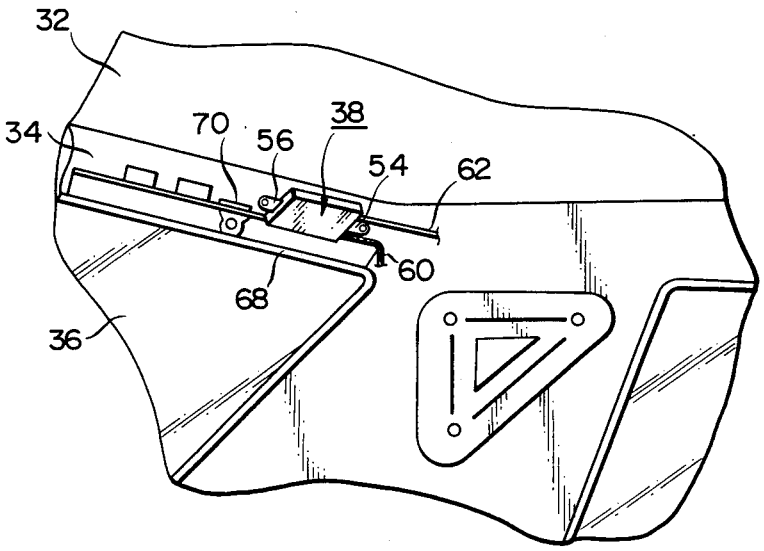
FIG. 1 is a perspective view showing the general construction of a preferred embodiment of the automobile antenna system in accordance with the present invention, in which an electromagnetic coupling type of high-frequency pickup is mounted on the rear periphery of the roof plate of an automobile.
Figure 2:
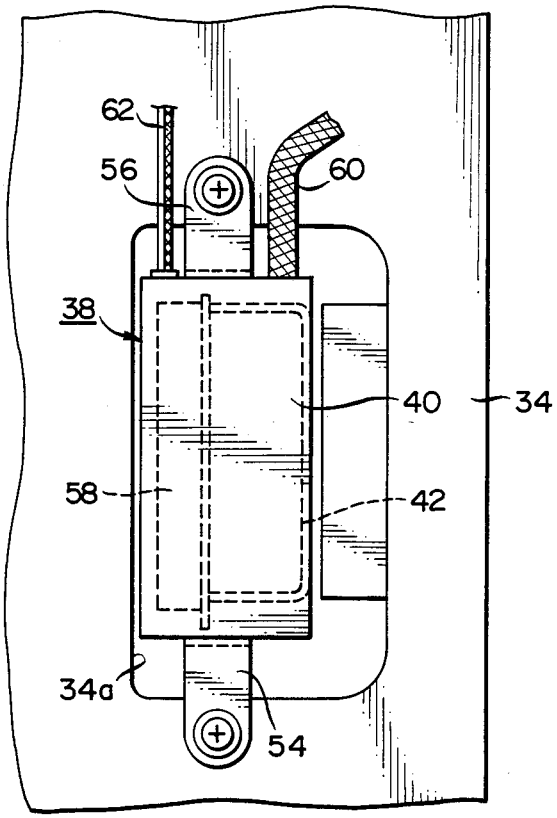
FIG. 2 is a plan view showing in detail a state wherein the high-frequency pickup shown in FIG. 1 is fixed.
Figure 3:
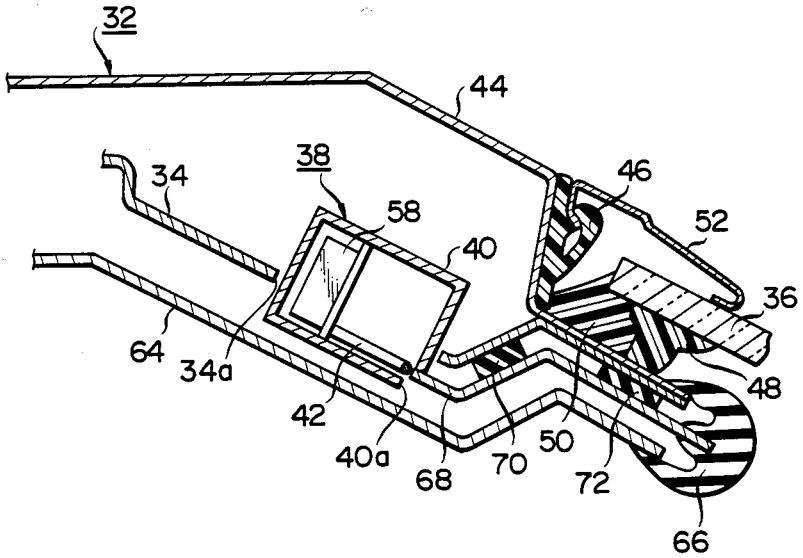
FIG. 3 is a cross-sectional view of the essential portion of the general construction shown in FIG. 1.

FIGS. 1 through 3 show one preferred embodiment in accordance with the present invention in which the high-frequency pickup is disposed in close proximity to the rear edge of the roof plate.

FIG. 1 shows a roof plate 32 in an exposed state. The metal roof plate 32 with a rear window frame 34 constituting the peripheral edge is connected to a rear glass 36.

As shown in detail in FIG. 2, a high-frequency pickup 38 includes a casing 40 made of metal for preventing external magnetic flux from reaching the interior, while the interior of the casing 40 contains a loop antenna 42, thus constituting an electromagentic coupling type of pickup. The construction is analogous to the foregoing probe containing a loop coil which, as described above, is used to examine the surface current distribution on the vehicle body.

FIG. 3 is a lateral cross-sectional view in which the high-frequency pickup 38 is secured to the roof plate 32. The roof plate 32 includes a roof panel 44 and the rear window frame 34 is secured to one end of the roof panel 44. The rear glass 36 is secured to the roof panel 44 by a fastener 46 and a dam 48 which airtightly adhere to each other by the medium of an adhesive 50. Also, a moulding 52 is secured between the roof panel 44 and the rear glass 36.

Furthermore, a roof garnish 64 is secured to the roof panel 44 inward of the rear window frame 34 of the roof plate 32 (inside the vehicle body), and an edge moulding 66 is fixed to the ends of the roof garnish 64 and the rear window frame 34 in combination.

An edge-moulding mounting retainer 68 for mounting the edge moulding 66 is disposed in the space between the rear window frame 34 and the roof garnish 64. The retainer 68 is separated from the rear window frame 34 by spacers 70 and 72 thereby facilitating the concentration of surface currents.

Figure 13:
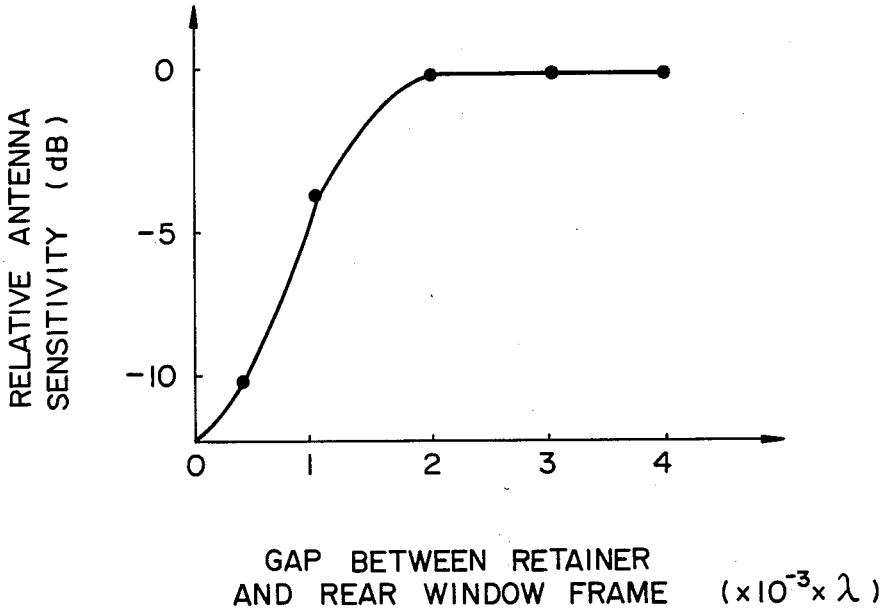
FIG. 13 is a graph showing variations in antenna sensitivity with respect to the gap between the rear windshield frame and the retainer.

FIG. 13 is a graph showing variations in antenna sensivity with respect to the gap between the rear window frame 34 and the retainer 68, that is, the varied values of a surface current density which reaches the maximum at about $2\times10^{10-3}\times$wavelength. On the basis of this result, the degree of concentration of surface currents flowing at each edge of the vehicle body can be enhanced by separating the retainer 68 from the rear window frame 34 by a distance corresponding to the above mentioned gap.

In accordance with the present invention, an opening 34*a* is formed in a portion of the rear window frame 34 and the casing 40 of the high-frequency pickup 38 is inserted into the opening 34*a* in such a manner that the loop antenna 42 of the high-frequency pickup 38 is disposed in face-to-face relationship with the edge of the retainer 68.

Specifically, the present invention is characterized by the loop antenna 42 of the high-frequency pickup 38 being disposed in close proximity to the edge of the retainer 68 and along the length thereof.

The retainer 68 is separated from the rear window frame 34 by a dimension approximately equivalent to ($2\times10^{-3}\times$wavelength). The longitudinal length is made substantially equal to the television band, for example, about half a wavelength with respect to a low frequency band (1 to 3 chs in Japan) of the VHF band, about one wavelength with respect to a high frequency band (4 to 12 chs in Japan) of the same band and about (2 to $4\times$wavelength) with respect to the UHF band. Therefore, concentration of surface currents in these frequency bands is further facilitated, whereby high sensitivity reception can be accomplished.

As illustrated in detail in FIG. 3, the casing 40 of the high-frequency pickup 38 has an opening 40*a* through which the longitudinal side of the loop antenna 42 is exposed, and the portion of the loop antenna 42 which is exposed through the casing 40 made of electrically conductive material is disposed in close proximity to and in face-to-face relationship with the edge of the edge-moulding mounting retainer 68.

Therefore, magnetic flux induced by high-frequency surface currents flowing in the edge portion of the retainer 68 is positively detected by the loop antenna 42 within the casing 40, and additionally, the casing 40 positively prevents external magnetic flux from reaching the interior thereof, thereby enabling the currents induced on the vehicle body to be detected with high sensitivity through the high-frequency pickup 38.

In order to positively position and secure the casing 40 of the high-frequency pickup 38 relative to the edge-moulding mounting retainer 68, L-shaped brackets 54 and 56, as shown in FIG. 2, are connected to the opposite ends of the casing 40 by using fastening means such as bolts and the brackets 54 and 56 are threadedly secured to the rear window frame 34.

A circuit section 58 which is connected to the loop antenna 42 is incorporated into the casing 40 of the high-frequency pickup 38 and a detected signal is processed by a preamplifier or similar device arranged in the circuit section 58. Furthermore, the high-frequency detected signal thus obtained is taken off through a coaxial cable 60 and is processed by the same circuit as that used in the above-mentioned measurement of surface current distribution. The circuit section 58 is supplied with electricity and signals for controlling the circuit section 58 through a cable 62.

The loop antenna 42 is constituted by a single-turn antenna and has a structure in which the coil thereof is insulation-coated so that it may be disposed in physical contact with the edge-moulding mounting retainer 68 in electrically isolated relationship therebetween, being forced against the end surface of the retainer 68. This further strongly forces magnetic flux caused by surface currents to cross the loop antenna 42.

In accordance with this embodiment, the side of the loop antenna 42 which is exposed through the casing 40 is disposed within 4.5 cm from the edge of the retainer 68, thereby enabling the detection of vehicle body surface currents flowing in the edge portion of the retainer 68 due to the induction caused by broacast waves of 50 MHz or greater, particularly FM-band or TV-band frequencies. FIG. 9 clearly shows the direction of flow of the vehicle body surface currents in this instance in which the currents flow along the edge portion of the vehicle body. Therefore, in accordance with this embodiment, the loop antenna 46 is disposed such that the length thereof extends along the edge of the retainer 68.

As described above, in accordance with the preferred embodiment of this invention, surface currents flowing in the edge portions of a vehicle body, particularly the edge of the roof plate, are electromagnetically detected by the high-frequency pickup, whereby it is possible to positively receive a high-frequency band without exposing any portion of the antenna system to the exterior. It is evident from this advantage that the system of this invention is remarkably useful as an automobile antenna system.

While an electromagnetic coupling type of pickup is employed as a high-frequency pickup in the above noted embodiment, a feature of this invention consists in the accomplishment of an antenna system capable of receiving waves coming from the exterior by detecting surface currents in the edge portion of a vehicle body, and not only the electromagnetic coupling type but also an electrostatic coupling type of pickup can be employed as a high-frequency pickup.

Referring to the electrostatic coupling type of pickup, a detecting electrode is disposed along the length of a peripheral edge of the metal vehicle body shown in the figures with an air layer or an insulating plate therebetween and high-frequency surface currents are taken off by the detecting electrode through the capacitance formed between the surface of a hinge and the detecting electrode, whereby it is possible to take off a high-frequency signal at a desired band.

Furthermore, in accordance with the present invention, a ferrite-core coil type of pickup may be used as a high-frequency pickup. In this case, this pickup is disposed in close proximity to the edge-moulding mounting retainer 68 in such a manner that the length of the ferrite core extends along the vehicle body surface current flowing in the edge portion of the retainer 68, whereby an induced current can be taken off by the coil wound around the ferrite core.

As described above, in accordance with the present invention, a broadcast wave receiving antenna for relatively high frequency bands such as the VHF band is formed by utilizing high-frequency surface currents developed at particular portions of a vehicle body, specifically in the peripheral edge of the edge-moulding mounting retainer whose longitudinal length is substantially equal to the wavelength of the television band, thus enabling a high-density, high-quality and low-noise detection. Moreover, it is possible to obtain a small-size and high-performance automobile antenna system without any need for a conventional pole antenna or similar device being exposed to the exterior.

It will be understood that the foregoing disclosure of the preferred embodiment of the present invention is for purposes of illustration only, and that the various structural and operational features disclosed hay be modified and changed in a number of ways, none of which involves any departure from the spirit and scope of the invention as defined in the hereto appended claims.

What is claimed is:

1. An automobile antenna system for detecting high-frequency surface currents induced on the automobile body by broadcast waves, said antenna system comprising:

high frequency pickup means including an electromagnetically shielded case, the case having an opening at one end, and a loop antenna having a longitudinal side and disposed within the case so that the longitudinal side of said loop antenna faces the opening in the case; and mounting means for mounting said high frequency pickup means so that the opening in the case faces an edge surface of an edge-molding mounting retainer of the automobile body, the edge-molding mounting retainer being separated from a windshield frame of the automobile body;

said high frequency pickup means being provided for detecting surface currents induced on the edge-molding mounting retainer which concentratedly flow along, the edge surface of the edge-molding mounting retainer.

2. An automobile antenna system according to claim 1 wherein said edge-moulding mounting retainer is secured to the roof plate of said automobile body in such a manner as to be separate from the window frame of said body as an individual member.

3. An automobile antenna system according to claim 1 wherein said edge-moulding mounting retainer has a length substantially equal to the wavelength of the broadcast signals being received.

4. An automobile antenna system according to any one of claims 1, 2 and 3, wherein said edge-moulding mounting retainer to which said high-frequency pickup means is secured is disposed in the vicinity of a rear window frame.

5. An automobile antenna system according to claim 1, wherein said case is made of an electrically conductive material and is shielded from magnetic flux which might invade through any portion other than said opening.

* * * * *